US005138999A

United States Patent [19]

Tomsett

[11] Patent Number: 5,138,999

[45] Date of Patent: Aug. 18, 1992

[54] FUEL PUMPING APPARATUS

[75] Inventor: Derek W. Tomsett, East Sussex, England

[73] Assignee: Lucas Industries Public limited Company, England

[21] Appl. No.: 783,007

[22] Filed: Oct. 28, 1991

[30] Foreign Application Priority Data

Nov. 29, 1990 [GB] United Kingdom ..... 9026013

[51] Int. Cl.[5] ..... F02M 37/04

[52] U.S. Cl. ..... 123/502; 123/179.17; 123/450

[58] Field of Search ..... 123/502, 179.17, 450; 417/462

[56] References Cited

U.S. PATENT DOCUMENTS

| | | | |
|---|---|---|---|
| 3,147,746 | 9/1964 | Hofer | 123/502 |
| 3,486,492 | 12/1969 | Lehnerer | 123/502 |
| 4,329,961 | 5/1982 | Johnston | 123/502 |
| 4,355,621 | 10/1982 | Yasuhara | 123/502 |
| 4,406,268 | 9/1983 | Eheim | 123/502 |
| 4,493,302 | 1/1985 | Kawamura | 123/502 |

FOREIGN PATENT DOCUMENTS

| | | | |
|---|---|---|---|
| 2600222 | 4/1977 | Fed. Rep. of Germany | 123/502 |
| 0073828 | 5/1982 | Japan | 123/502 |

*Primary Examiner*—Carl S. Miller

*Attorney, Agent, or Firm*—Andrus, Sceales, Starke & Sawall

[57] ABSTRACT

A rotary distributor type fuel pump has an annular cam ring which is movable by a fluid pressure actuated piston to control the timing of fuel delivery. The cylinder containing the piston has an enlarged portion in which is slidable a sleeve located about the piston. The sleeve is engagable with the piston and one end is exposed to a fluid pressure applied to the piston to assist the movement of the piston when a valve is set such that an annular space is part defined by the other end of the sleeve, is connected to a drain.

4 Claims, 1 Drawing Sheet

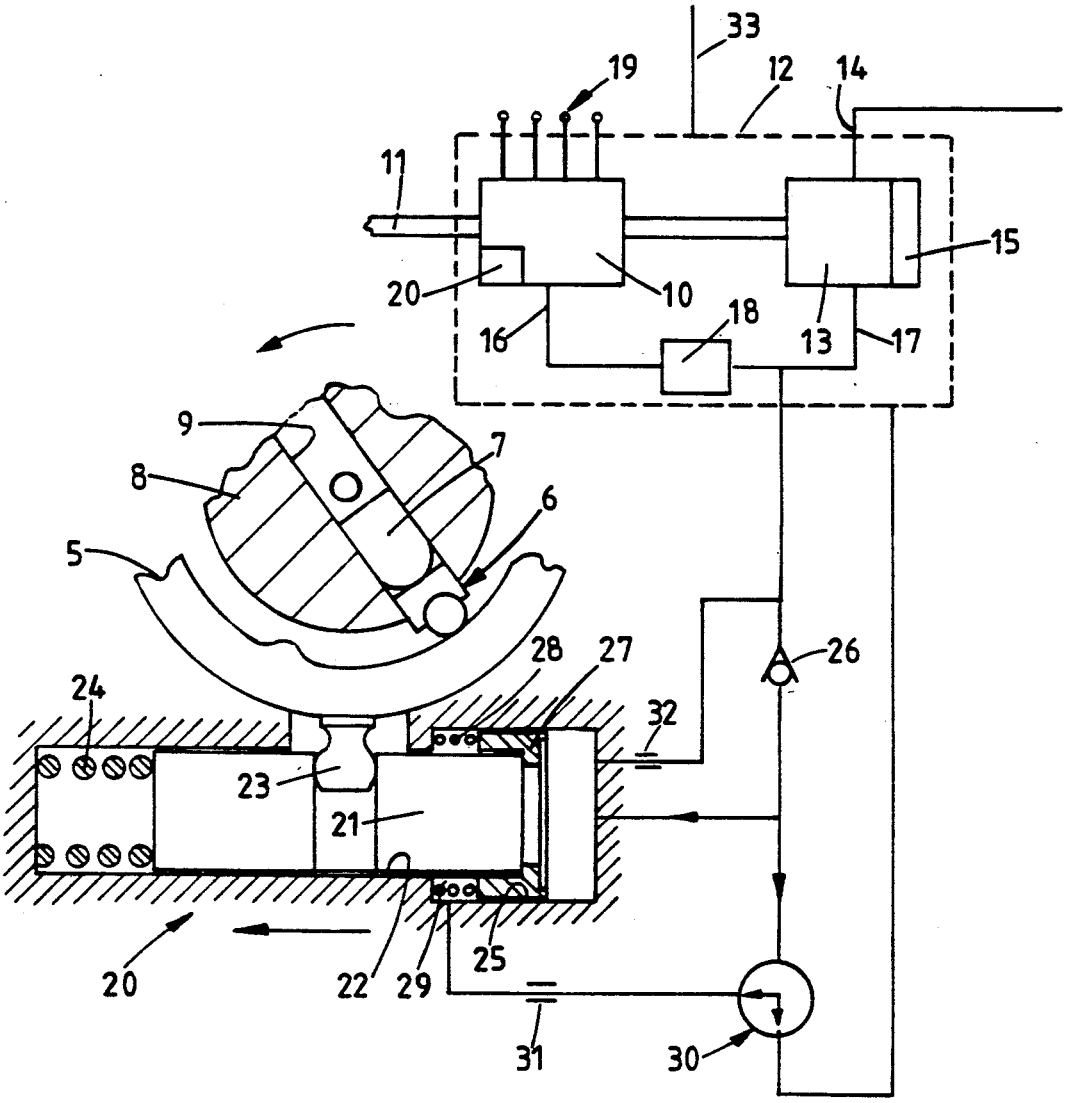
33
19
12
14
11
15
20
10
18
16
13
17
9
7
8
6
5
28
27
26
24
32
23
21
20
22
29
25
31
30

FUEL PUMPING APPARATUS

This invention relates to a fuel pumping apparatus for supplying fuel to an internal combustion engine of the rotary distributor type and comprising a pumping plunger housed in a bore, a cam which imparts inward movement to the plunger as the distributor member rotates, passage means through which fuel can be supplied to the bore, fuel displaced from the bore during inward movement of the plunger being supplied to an outlet, means for controlling the quantity of fuel supplied to the bore and a resiliently biased piston coupled to the cam and responsive to fluid under pressure delivered by a source, the pressure of the fluid varying in accordance with the speed at which the apparatus is driven, for controlling the timing of fuel delivered through the outlet.

The apparatus is intended to supply fuel to a compression ignition engine and in many such engines it is desirable when the engine is cold, to advance the timing of fuel delivery when the engine is idling. The piston is located in a cylinder the axis of which extends at right angles to but is spaced from, the axis of rotation of the distributor member. It is known from GB-A-1530130 to provide for the purpose of altering the degree of advance, a further piston which is larger in diameter than the first mentioned piston and which when supplied with fluid under pressure engages the first mentioned piston to urge it in the direction to advance the timing of fuel delivery. A disadvantage with this arrangement is that the provision of the further piston together with the cylinder in which it is mounted, adds to the effective width of the apparatus thereby making it more difficult to accommodate the apparatus on an engine structure. The further piston in GB-A-1530130 is provided to achieve adjustment of the position of the cam in accordance with the quantity of fuel being supplied to the associated engine.

The object of the present invention is to provide an apparatus of the kind specified in a simple and convenient form.

According to the invention an apparatus of the kind specified comprises a stepped cylinder said piston being slidable in the narrower portion of the cylinder and extending into the wider portion thereof, an annular sleeve slidable within the wider portion of the cylinder and about the portion of the piston extending therein, abutment means on the sleeve engagable with said piston, passage means through which fluid at said pressure is admitted to the wider end of the cylinder to act upon the piston and one end of said sleeve and valve means operable to connect the annular space defined in part by the other end of the sleeve with a drain or with the fluid pressure source, the arrangement being such that when said space is connected to the drain the fluid pressure acting on the one end of the sleeve will assist the action of the fluid pressure acting on the piston to advance the timing of fuel delivery and when the space is connected to said source the fluid pressure acting on the piston alone will determine the timing of fuel delivery.

One example of a fuel pumping apparatus in accordance with the invention will now be described with reference to the accompanying diagrammatic drawing.

Referring to the drawing the apparatus includes a high pressure pump 10 of the rotary distributor type and which is driven from the associated engine by way of a drive shaft 11. The high pressure pump is contained within a housing 12 as also is a low pressure pump 13 which has a fuel inlet 14 connected to a source of fuel for example the fuel tank of the vehicle by way of a suitable filter. The inlet and outlet of the low pressure pump are interconnected by way of a pressure relief valve 15 which ensures that the outlet pressure of the pump is controlled so that it varies in accordance with the speed of the associated engine.

The high pressure pump 10 has a fuel inlet 16 which is connected to the outlet 17 of the low pressure pump by way of a fuel control device 18 which may for example be an adjustable throttle which is controlled by an engine speed governor.

The high pressure pump has a plurality of outlets 19 which in use are connected to the in section nozzles respectively of the engine.

In known manner the high pressure pump includes a bore 9 formed in the rotary distributor member 8 of the pump, the bore containing a pair of plungers 7 only one of which is shown in which through respective cam followers 6 at their outer ends, engage with the internal peripheral surface of an annular cam ring 5 which is secured within the housing of the apparatus. The bore 9 containing the plungers is in communication with a fuel inlet passage and also a fuel outlet passage formed in the distributor member, the outlet passage communicating with the outlets 19 in turn during successive inward movements of the pumping plungers and the inlet communicating with the fuel inlet 16 during the periods when the plungers 7 are allowed to move outwardly by the lobes of the cam ring. The angular setting of the cam ring is adjustable so that the timing of fuel delivery to the associated engine can be varied. The adjustment mechanism 20 comprises a piston 21 which is located in a cylinder 22, the piston being coupled by means of a peg 23 to the cam ring. The piston is biased by a coiled compression spring 24 in a direction to retard the timing of delivery of fuel to the engine. The piston 21 projects into an enlarged portion 25 of the cylinder and the wider end of the cylinder is in communication with the outlet 17 of the low pressure pump by way of a nonreturn valve 26 the purpose of which is to minimise movement of the piston 21 and the cam ring 8 under the action of the forces generated when the cam followers engage the cam lobes.

Slidably located about the portion of the piston 21 which extends into the enlarged portion 25 of the cylinder, is a sleeve 27 which itself is slidable in the enlarged portion of the cylinder. The sleeve 27 is biased towards the enlarged end of the cylinder by means of a light spring 28 this being located in the smaller end of the cylinder, which is in communication with the interior of the housing 12. Moreover, the inner peripheral surface of the sleeve is of stepped form so that it defines an annular abutment surface which can engage the piston 21. The one end of the sleeve remote from the spring is subject to the pressure in the wider end of the cylinder and intermediate the other end of the sleeve and the step formed between the narrower and wider portions of the cylinder is an annular space 29 which can be connected by way of a changeover valve 30, either to the wider end of the cylinder so that it contains fuel at the outlet pressure of the low pressure pump, or to a drain which conveniently is the interior of the housing of the apparatus. During the operation of the apparatus fuel will leak from the high pressure pump and possibly also the low pressure pump into the interior of the housing and this fuel can escape form the housing through a drain outlet 33. A valve may be provided in the outlet so that the interior of the housing of the apparatus is at a positive pressure relative to atmosphere.

Assuming for the moment that the space 29 is connected by way of the valve 30 to the outlet of the low pressure pump. In this situation the sleeve 27 is pressure balanced and it will tend to assume a position adjacent the enlarged end of the cylinder. The pressure developed by the low pressure pump 13 acting on the end surface of the piston 21 will move the piston against the action of the spring 24 to determine the timing of fuel delivery to the associated engine and as the engine speed increases, the resultant pressure increase will move the piston 21 further against the action of the spring 24. When the engine is idling the piston will assume a position to the right of that in which it is shown. Nevertheless, with the engine hot the operation of the engine will be satisfactory. If however the engine is cold it is found that improved operation of the engine can be obtained by advancing the timing of fuel delivery particularly at idling. This is particularly the case with the type of pump described in which as the quantity of fuel supplied by the pump is decreased, the timing of fuel delivery becomes more retarded. The invention is also applicable to pumps of the so called constant start of injection type in which the instant of fuel delivery does not vary as the quantity of fuel is delivered varies. When the engine is cold therefore the valve 30 is set to the position in which it is shown and the space 29 is therefore at a low pressure. In this situation the fuel pressure acting on the sleeve 27 will move the sleeve into engagement with the piston 21 and will assist the movement of the piston against the action of the spring 24. The timing of fuel delivery therefore will be advanced thereby ensuring better combustion of the fuel when the engine is cold.

The valve 30 is controlled by a temperature dependent signal and as the temperature of the associated engine increases, a point will be reached at which the valve is moved to its alternative position in which the space 29 is connected to the outlet of the low pressure pump. Thereafter it is the force exerted on the piston alone which determines the timing of fuel delivery. The extent of movement of the sleeve can be determined by a fixed or an adjustable stop and if desired and as shown, the passage which communicates with the space 29 may be provided with a restricted orifice 31. The orifice 31 in conjunction with control clearances between the sleeve and the wall of the cylinder, acts to provide variation in the degree of advance as the engine gradually warms up. In this situation the fuel temperature will rise and therefore its viscosity will reduce allowing for a build up of pressure in the space 29 thereby reducing the force applied to the piston by the sleeve. The valve 26 is provided with a by-pass restrictor 32 in known manner, the purpose of this restrictor being to permit rapid movement of the piston under the action of its spring when the outlet pressure of the low pressure pump 13 falls.

I claim:

1. A fuel pumping apparatus for supplying fuel to an internal combustion engine of the rotary distributor type comprising a pumping plunger housed in a bore, a cam which imparts inward movement to the plunger as the distributor member rotates, passage means through which fuel can be supplied to the bore, fuel displaced from the bore during inward movement of the plunger being supplied to an outlet, means for controlling the quantity of fuel supplied to the bore, and a resiliently biased piston coupled to the cam and responsive to fluid under pressure delivered by a source, the pressure of fluid varying in accordance with the speed of the associated engine to control the timing of fuel delivered through the outlet, a stepped cylinder, the piston being slidable in the narrower portion of the cylinder and extending into the wider portion thereof, an annular sleeve slidable within said wider portion and also about the portion of the piston therein, passage means connecting the wider end of abutment means on the sleeve engagable with the piston, so that the fluid pressure acts upon the piston and one end of the sleeve of the cylinder with said source and valve means operable to connect an annular space defined in part by the other end of the sleeve with a drain or with said source, the arrangement being such that when said space is connected to the drain the fluid pressure acting on the one end of the sleeve will assist the action of the fluid pressure acting on the piston to advance the timing of fuel delivery and when the space is connected to said source the fluid pressure acting on the piston above will determine the timing of fuel delivery.

2. An apparatus according to claim 1, in which said valve means is controlled by a temperature dependent signal.

3. An apparatus according to claim 1, in which the sleeve is biased by a spring towards the end of the wider portion of the cylinder remote from the narrower portion thereof.

4. An apparatus according to claim 1, in which a restriction interposed between the valve means and said space and a control clearance between the sleeve and the wall of the wider portion of the cylinder, whereby the pressure in said space increases as the temperature increases and when the valve member is set to place said space in communication with the drain.

* * * * *